US005645863A

United States Patent [19]

Cuman et al.

[11] Patent Number: 5,645,863

[45] Date of Patent: Jul. 8, 1997

[54] EQUIPMENT FOR UNMOLDING SANITARY WARE

[75] Inventors: Giorgio Cuman, Cordenons; Delfino Rovere, Cusano Di Zoppola, both of Italy

[73] Assignee: American Standard Inc., Piscataway, N.J.

[21] Appl. No.: 459,582

[22] Filed: Jun. 2, 1995

[51] Int. Cl.[6] ..... B28B 1/26

[52] U.S. Cl. ..... 425/84; 425/436 R; 425/437; 425/438

[58] Field of Search ..... 425/84, 85, 436 R, 425/437, 438, 444

[56] References Cited

U.S. PATENT DOCUMENTS

| | | | |
|---|---|---|---|
| 2,294,476 | 9/1942 | Mooney | 425/84 |
| 3,792,149 | 2/1974 | Derror | 425/444 |
| 3,836,312 | 9/1974 | Derror | 425/436 R |
| 4,514,166 | 4/1985 | Ichizawa et al. | 425/438 |
| 4,867,662 | 9/1989 | Shimahara et al. | 425/437 |
| 5,083,911 | 1/1992 | Hisaeda et al. | 425/84 |
| 5,120,211 | 6/1992 | Ito et al. | 425/84 |
| 5,183,668 | 2/1993 | Murata et al. | 425/84 |

FOREIGN PATENT DOCUMENTS

| | | |
|---|---|---|
| A-2 407 803 | 1/1979 | France . |
| A-36 11 918 | 10/1986 | Germany . |
| A-1 210 759 | 9/1989 | Italy . |
| A-01 022 523 | 1/1989 | Japan . |

*Primary Examiner*—Thomas R. Weber

*Attorney, Agent, or Firm*—Ann M. Knab; Elaine Brenner Robinson

[57] ABSTRACT

An apparatus for de-molding sanitary ware castings from porous molds, and in particular, from synthetic resin molds, comprising a carriage capable of traveling on rails parallel to the plane of the opening of a mold. The carriage moves to and from a position between separated mold parts of the mold and a position outside of the mold. The carriage includes an upper frame structure capable of displacement in a direction at right angles to the rails, on which is mounted at least one form capable of matching, at least in part, the outward shape of the piece to be molded. The mold is connected to the upper structure by an intermediate means of variable geometry so as to allow a range of motion. A pneumatic means is included to retain the form in contact with the cast piece.

6 Claims, 8 Drawing Sheets

EQUIPMENT FOR UNMOLDING SANITARY WARE

BACKGROUND OF THE INVENTION

The present invention relates generally to the process of manufacturing sanitary ware by slip casting sanitary ware in porous molds and, in particular, to the process of de-molding or removing the cast articles from the molds.

Slip casting is the molding process which is typically used when complicated shapes are desired. Mold pans, usually comprising two in number, are paired together to create a cavity into which slip is poured. Dewatering of the slip occurs through the molds which absorb a portion of the water. The casting is then allowed to harden. At the end of the casting operation, the mold parts are separated and the casting remains in contact with one of the mold parts.

One of the critical steps in the slip casting process is the removal of the casting from the mold part to which it adheres, and its subsequent placement on a line in preparation for the subsequent steps of drying and firing. Removal of the casting is done by hand with the aid of suitable support structures and is performed with extreme care to avoid irreparable damage to the casting, which is still quite soft, and continued adherence of any surface portions thereof to the mold.

The use of porous resin molds in place of the traditional plaster molds has drastically reduced the time required for casting although the de-molding time still remains comparatively long. Thus, it is apparent that an efficient automated operation for de-molding slip castings is desirable, particularly for use with resin molds, whereby the integrity of the casting is maintained.

SUMMARY OF THE INVENTION

An object of the invention is to provide means capable of automatically demolding castings from the porous molds in which they are formed.

Another object is to provide a means for automatically removing castings from casting presses which employ resin molds.

These and other objects and advantages are achieved by the present invention, which provides an apparatus for de-molding slip castings from molds which includes a carriage capable of passing between two mold parts when in separated position to expose a casting. On the carriage is mounted at least one form having a wide angle of motion enabling it to be placed in a position at a distance from the casting to be de-molded or in a position in contact with the casting to be de-molded. In accordance with the invention, the form may be designed to match the exposed surface of the casting to be de-molded in whole or in part, and may be fixed to at least a portion of the casting surface and may adhere to it without damaging it.

The form is further provided, in accordance with the invention, with a wide angle of motion for moving the casting slightly to detach it gradually, without damaging it, from the mold part on which it rests. Once the form has retrieved the casting, the carriage moves from its present position between the mold parts and travels to a conveyor line upon which is placed the casting, with or without its supporting form.

BRIEF DESCRIPTION OF THE DRAWINGS

The invention will be more fully appreciated from the following detailed description when the same is considered in connection with the accompanying drawings in which.

DETAILED DESCRIPTION OF THE INVENTION

Figure 1:
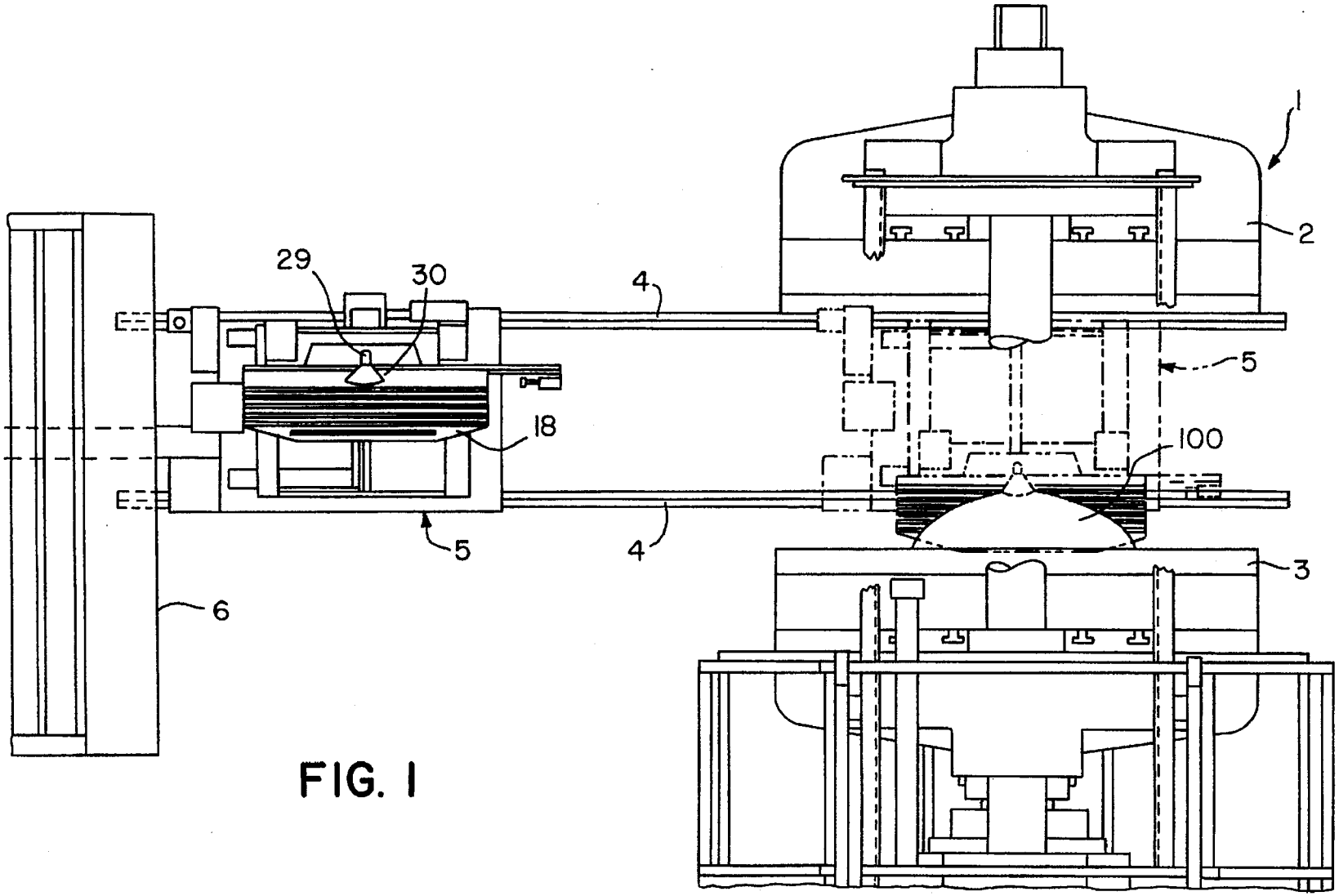
FIG. 1 shows a top plan view of an apparatus for de-molding castings from molding equipment in accordance with the claimed invention.

Reference is now made to the figures which show a press 1 for forming sanitary fixtures, comprising two mold support structures, upper mold support 2 and lower mold support 3, positioned directly opposite from each other and each bearing a mold section fabricated of a porous resin. FIG. 1 shows a partly visible mold section bearing molded piece 100. Located below mold supports 2 and 3 is a pair of rails 4 upon which carriage 5 travels, capable of being placed in a first position between the mold sections within mold supports 2 and 3 and in a second position outside of press I near a conveyor or support platform 6.

Figure 2:
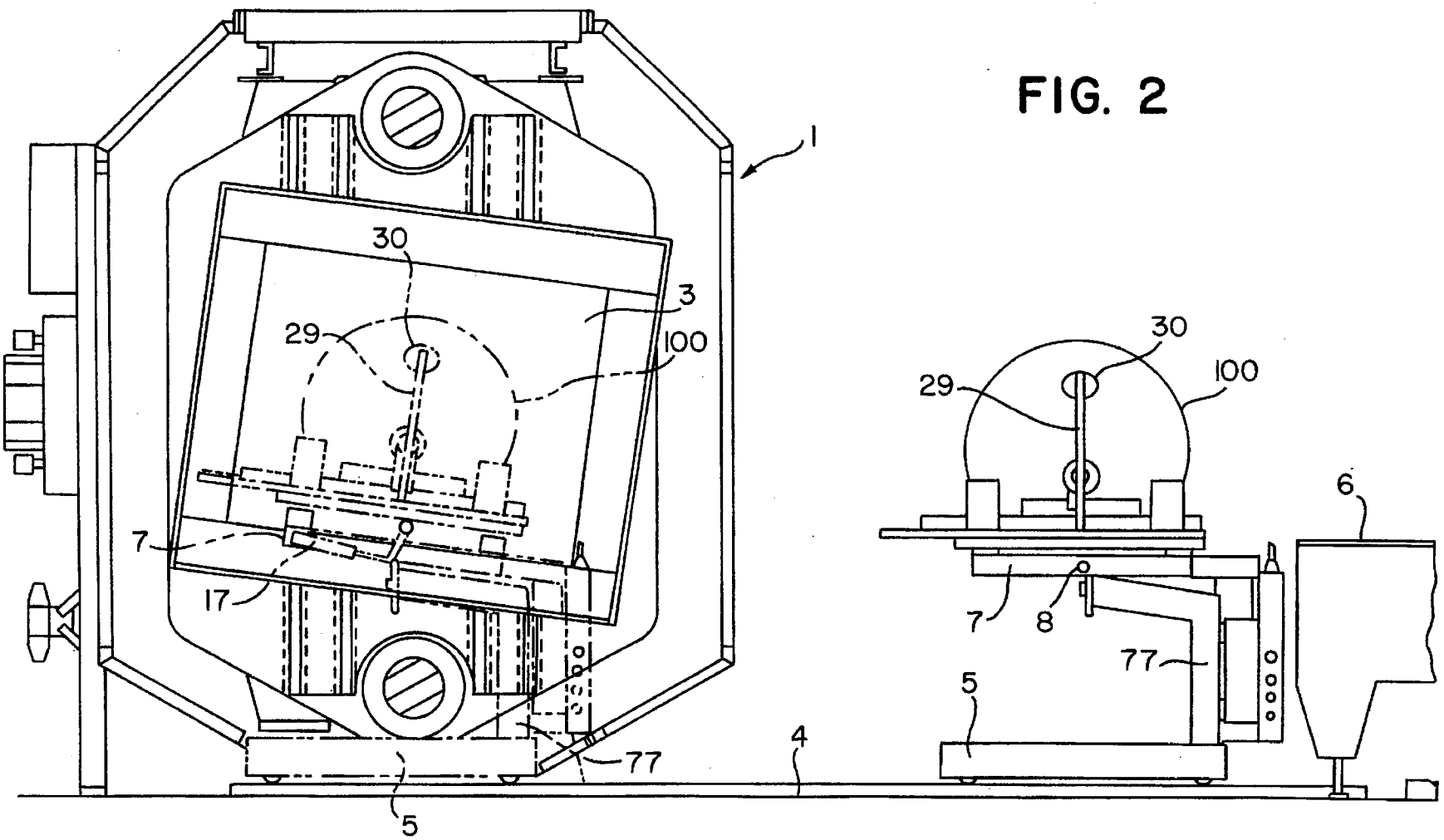
FIG. 2 is a partial side view of the apparatus shown in FIG. 1, shown both in position between the molds of the forming press and in position outside the forming press.

Reference is made to FIGS. 1 through 7, which show a carriage 5 having a flat top frame 7 thereon and supported by two brackets 77. Frame 7 is capable of oscillating or rotating about an axis 8 at right angles to rails 4 and is actuated by cylinder 9. When carriage 5 is outside of press 1 as shown in FIG. 2, frame 7 is horizontal. When carriage 5 is within press 1 between mold supports 2 and 3, frame 7 is inclined so as to be parallel to the base of molded casting 100, which in FIGS. 1 through 7, is a wash basin. It should be stated that the present invention is not limited to any particular sanitary ware and may be used for manufacturing a variety of sanitary ware of various shapes and sizes.

Figure 3:
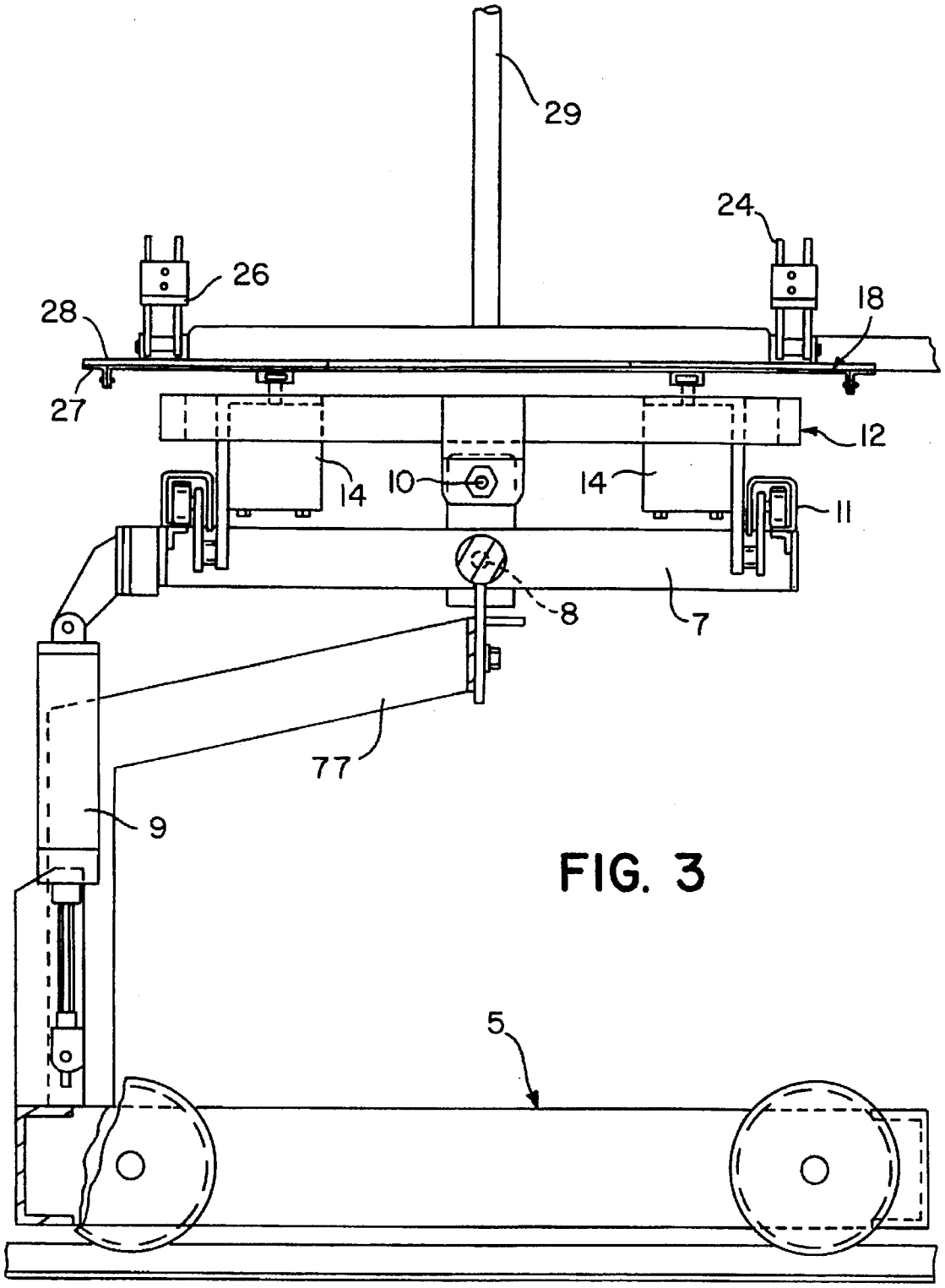
FIG. 3 is a partial side view of the apparatus viewed from the side opposite of that shown of FIG. 2.
Figure 4:
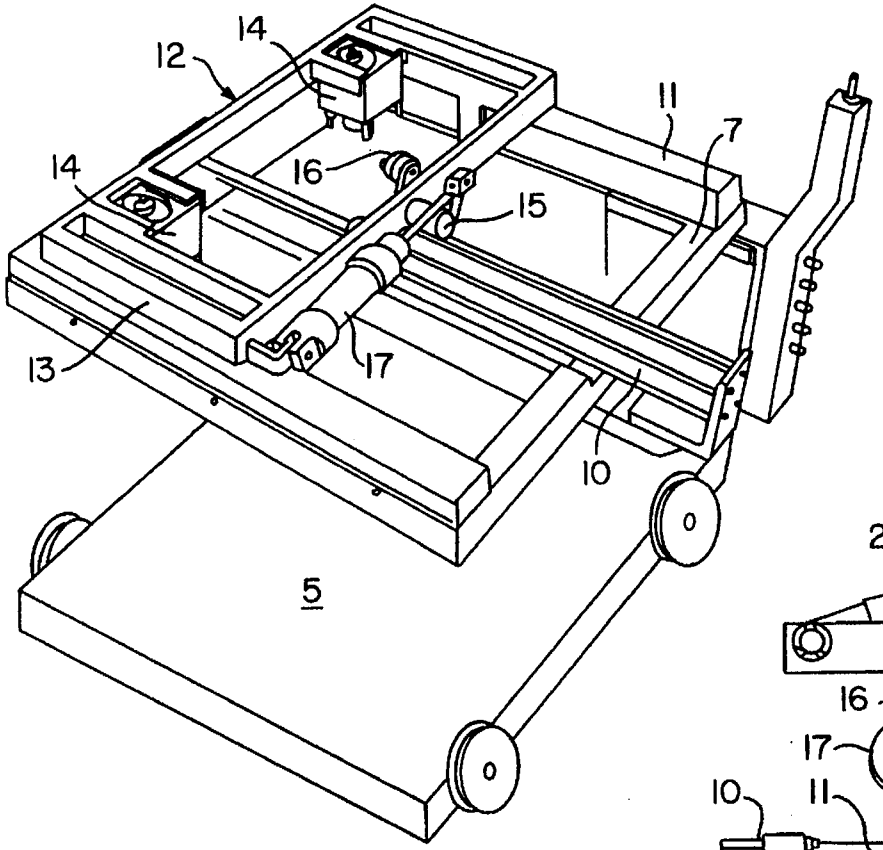
FIG. 4 is a partial perspective view of the apparatus of the invention.
Figure 5:
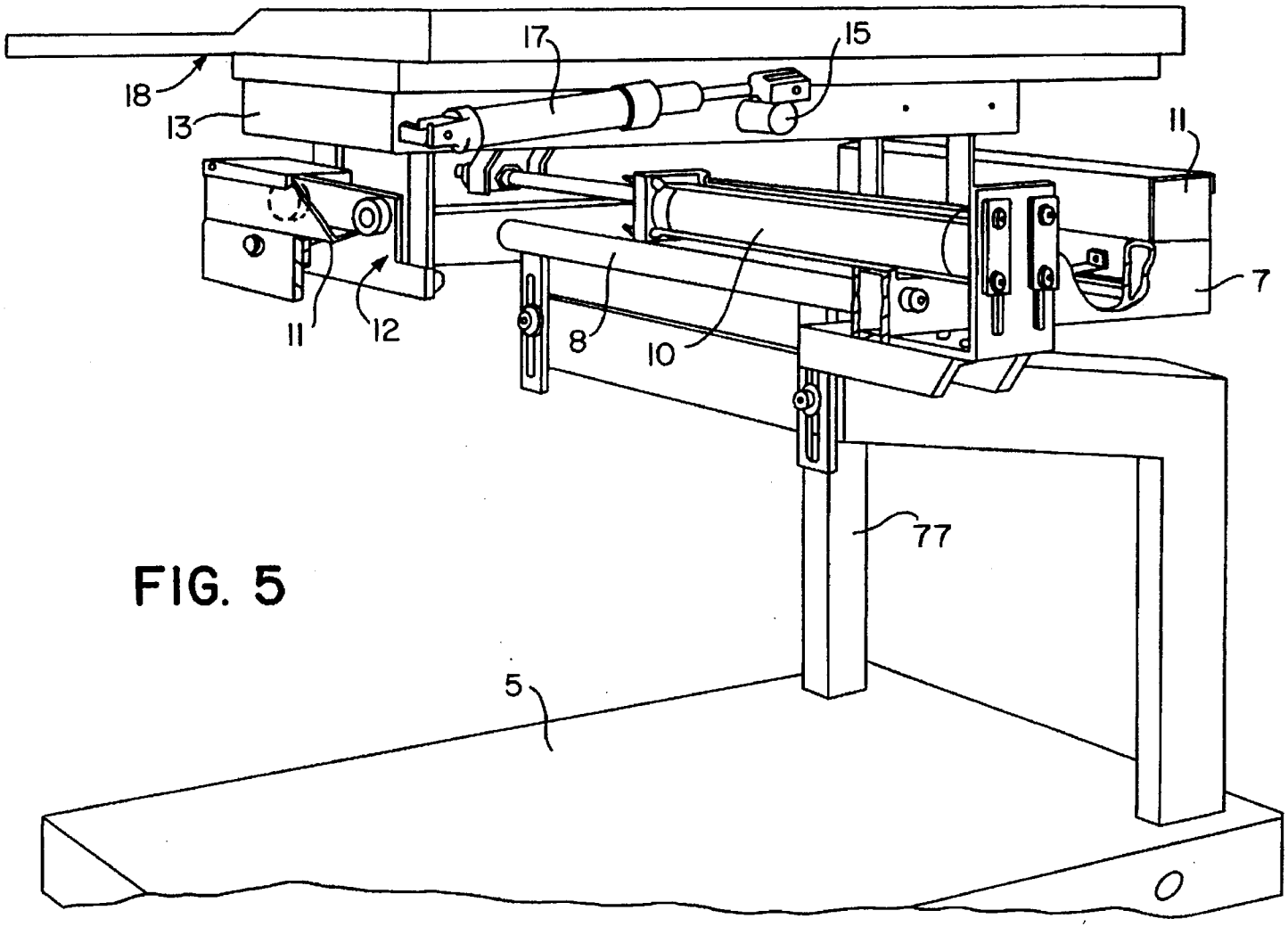
FIG. 5 is another perspective view of the apparatus of the invention.
Figure 6:
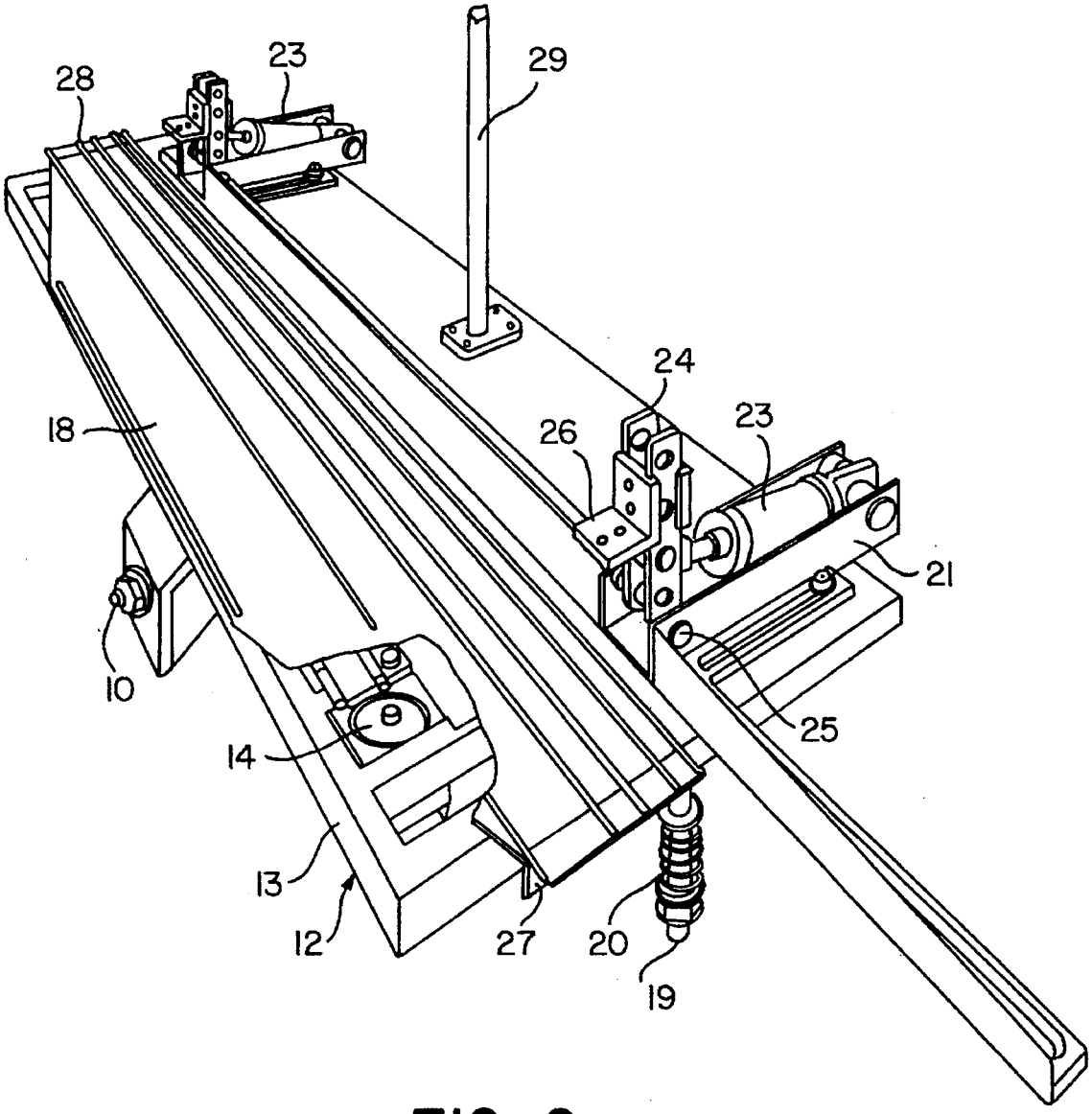
FIG. 6 is still another perspective view of the apparatus of the invention.

Flat frame 7, as shown in FIG. 3, comprises two guides 11 parallel to shaft 8, on which a frame structure 12 slides and which is actuated by cylinder 10. Carriage 5 comprises, on its underside, a motor (not shown) for controlling its travel on rails 4. Structure 12, as shown in FIG. 4, comprises a flat frame 13 having near its forward side, two cylinders 14, and at the center of the opposed side, crank 15 with roller 16 oscillating under the action of cylinder 17. Reference is made to FIG. 6 which shows platform 18 positioned atop frame 13. Platform 18 is supported on its forward end on the shafts of cylinders 14 and on its rearward end on rollers 16 of crank 15 as shown in FIG. 4. A pair of shafts 19 retain platform 18 in position with the aid of elastic support means or springs 20.

Figure 7:
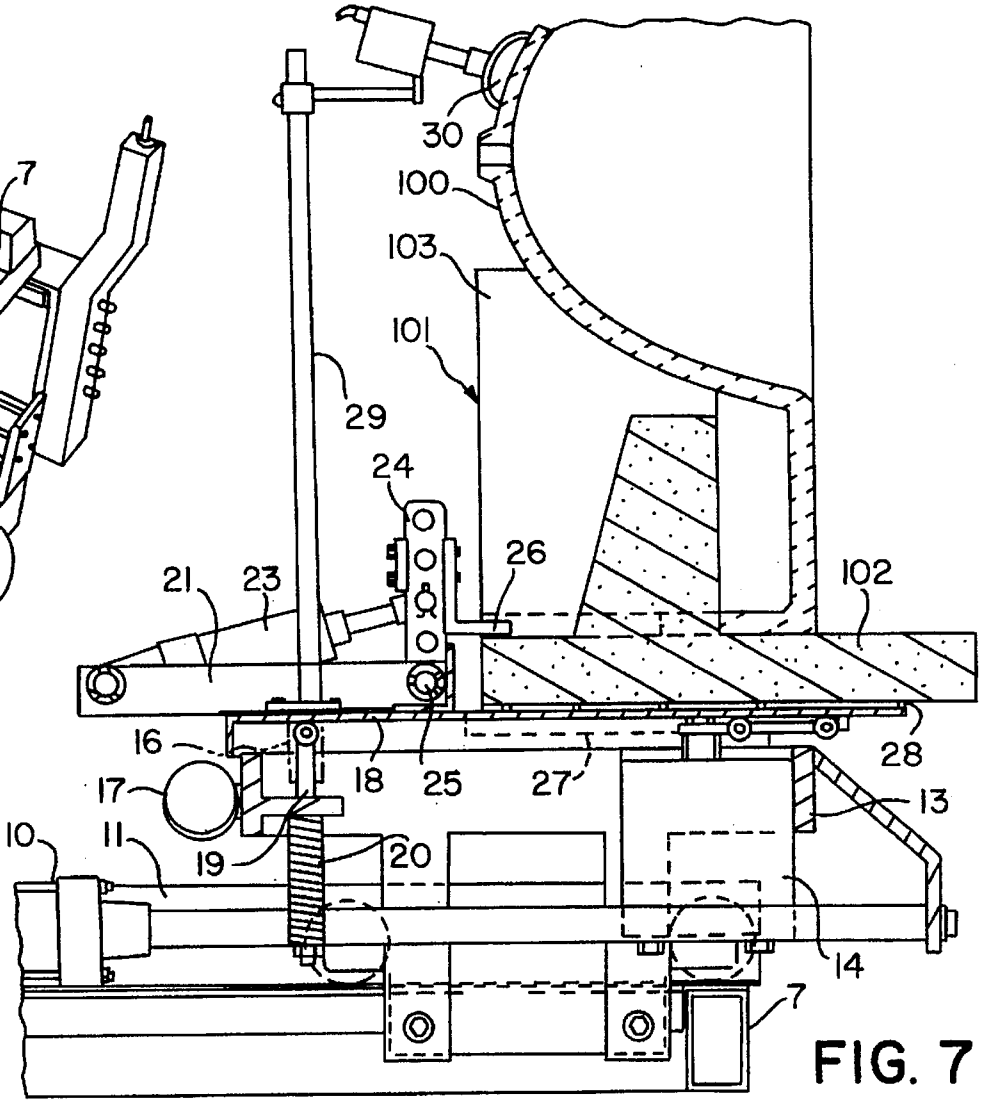
FIG. 7 is a side view of the apparatus of the invention showing a casting removed from the mold.

Rearward of platform 18 are two projections 21 bearing two cylinders 23 having shafts acting upon two small oscillating frames 24 coupled to the anterior ends of projections 21, along their aligned pivots 25. A vertically adjustable jaw or hinge 26 protrudes forward from each frame 24. As shown in FIG. 7, jaws 26 are capable of locking form 101 on platform 18, which form 101 comprises a base 102 from which two plane and parallel walls 103 extend. Form 101 is shaped on one side so as to match the posterior shape of basin 100, to be removed. Jaws 26 act on the posterior portion of base 102, locking it on platform 18. Form 101 may be fabricated of wood, resin or other like material. On the anterior portion of platform 18 is fixed a frame 27 composed of two lateral members between which parallel rods 28 are welded, being supported on the platform 18. Behind platform 18, a suction cup 30 is mounted on a vertical column 29 which is centrally positioned on platform 18. Platform 18, cylinders 14 and crank 15 represent intermediate means which allows freedom of movement for form 101, assisting in the detachment of the casting from the mold.

Figure 8:
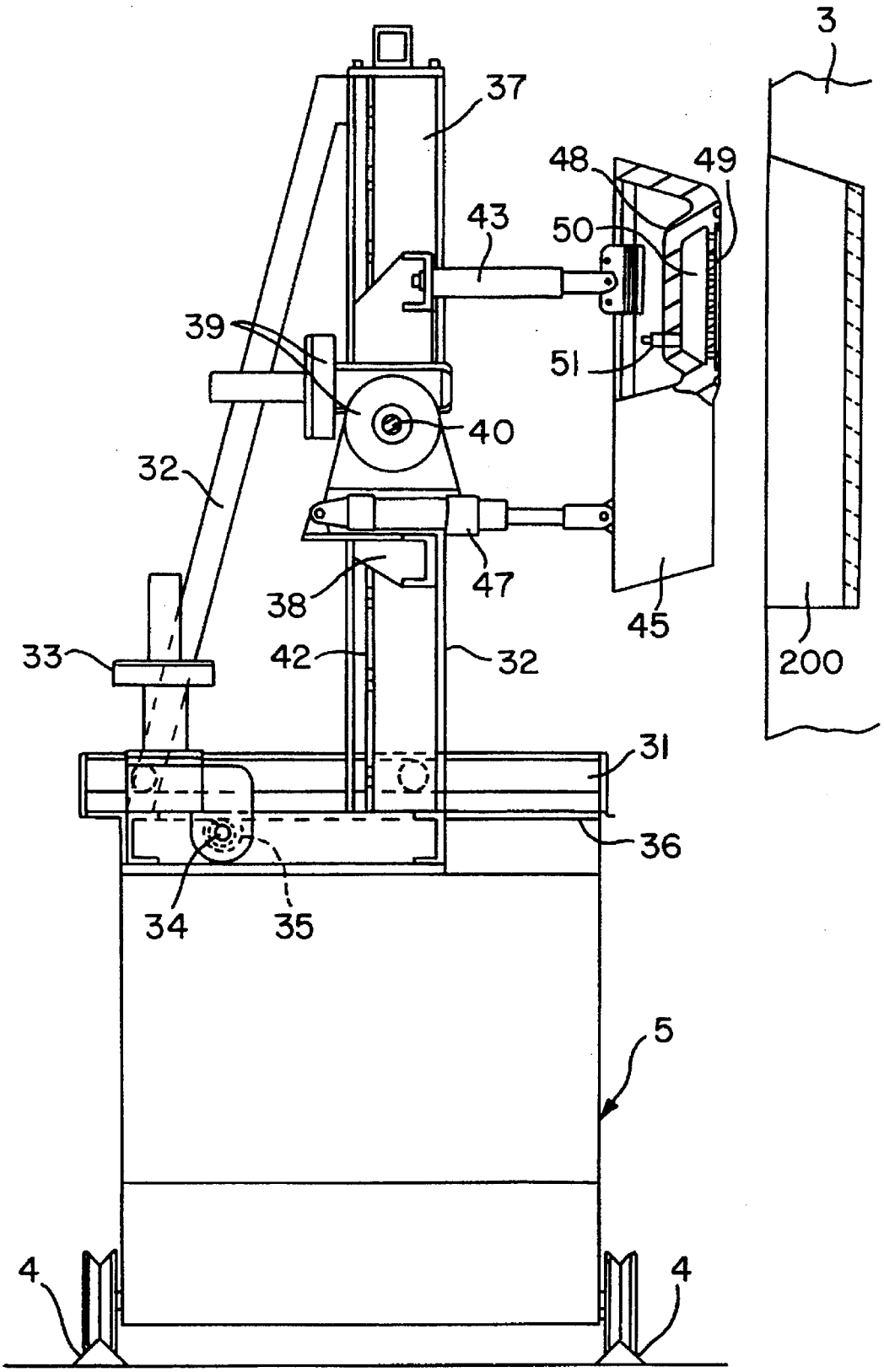
FIG. 8 is a side view of the another embodiment of the invention showing an apparatus for de-molding cast columns.
Figure 9:
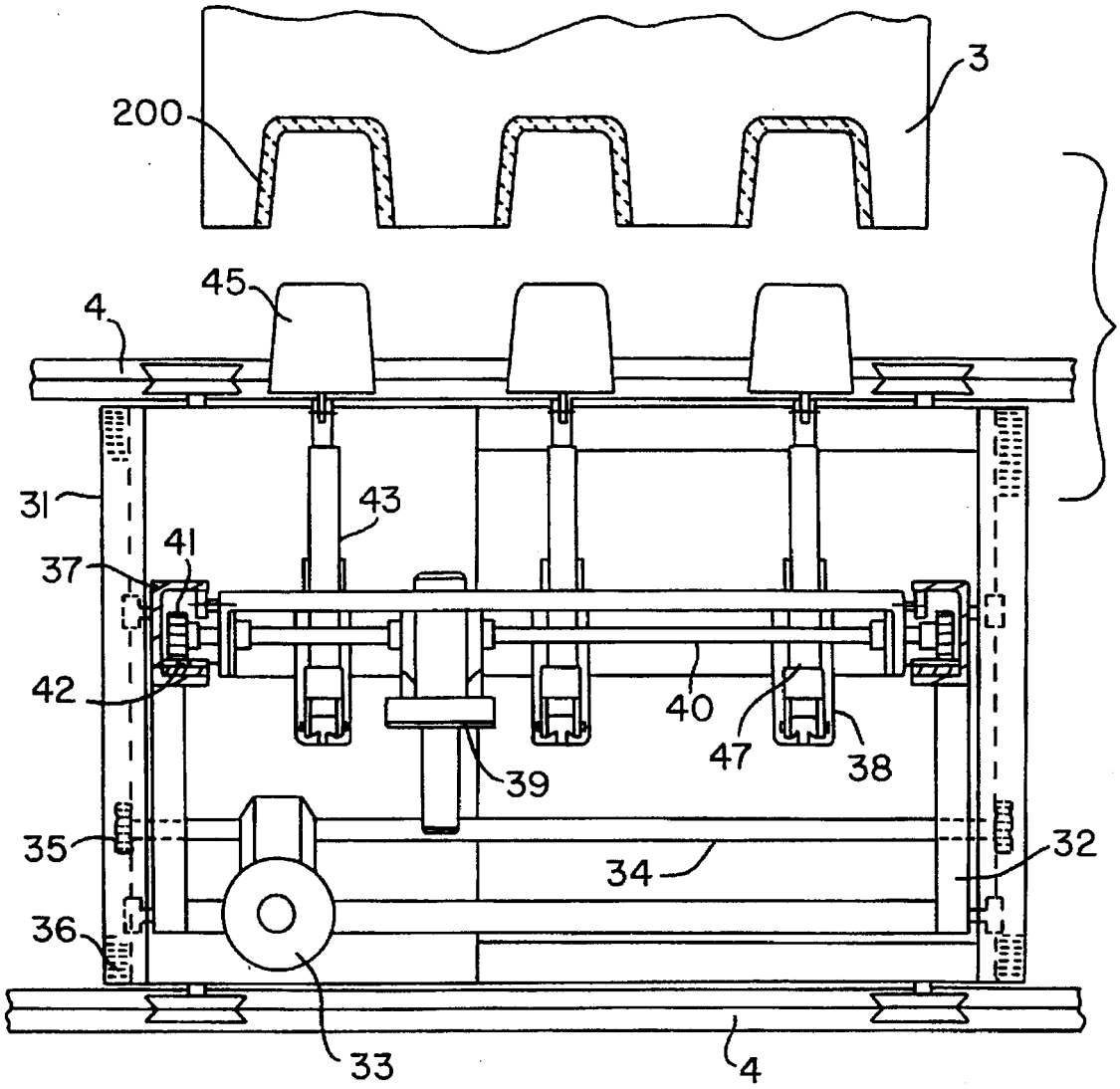
FIG. 9 is a sectional plan view of FIG. 8.

In accordance with a second embodiment of the invention, illustrated in FIGS. 8 and 9, carriage 5 traveling on rails 4 includes a pair guides 31 disposed at fight angles to rails 4, upon which vertical structure 32 travels. At the base of vertical structure 32 is located electric motor 33 connected to a gear box, actuating transverse shaft 34. Shaft 34 includes a pair of pinions 35 on its ends meshing with two racks 36 parallel to guides 31. By virtue of this arrangement, electric motor 33 controls the travel of structure 32. Structure 32 comprises two anterior guides 37, vertical and facing each other, along which flat frame 38 travels vertically. Structure 32 includes electric motor 39 connected to a gear box which is similar to motor 33 and which actuates transverse shaft 40. Shaft 40 is coupled, at its ends, to two pinions 41 meshing with two racks 42 integral with guides 37. Accordingly, motor 39 controls the vertical movement of flat frame 38 with precision. Frame 38, in its upper portion, includes three aligned co-planar projections 43, which have telescoping capability and thus, have variable length. At the free end of each projection 43 is form 45 capable of matching the inside of a wash stand column 200. Each form 45 is connected below to frame 38 by a cylinder 47 substantially parallel to overlying projection 43. Thus, each form 45 can be made to oscillate slightly in the plane defined by projection 43 and cylinder 47.

The projections 43 and the cylinders 47 represent intermediate means capable of allowing an auxiliary freedom of motion of form 45, assisting in the detachment of the casting from the mold. Each form 45 has in its upper portion a recess 48 in combination with flat surface 49 which enclose a chamber 50 capable of being placed in communication, through valve 51, with a depression chamber.

The operation of the invention is as follows. After the mold parts of press 1 have been distanced from each other, carriage 5 is moved along rails 4 to a position between mold parts 2 and 3 with the means to remove the casting just formed positioned proximate the mold parts.

In accordance with the embodiment intended for unmolding basins, form 101 is clamped to platform 18. Once the carriage is positioned between the two separated mold parts, cylinder 9 is actuated, inclining flat frame 7 and upper platform 18, so as to position platform 18 parallel to the base of basin 100 which is to be de-molded. At this point, the actuation of cylinder 10 causes the frame 13 and hence the entire platform 18 to travel with mounting form 101 until the latter comes into contact with basin 100. Suction cup 30 also in contact with basin 100, is depressurized to remain adhered thereto with some force. The basin rests on form 101, held thereto by suction cup 30, and is ready for detachment from the mold.

The careful detachment of the basin is effected by the motions of platform 18, which withdraws from the mold parts while being oscillated gently by cylinders 14 and posterior crank 15, actuated by the cylinder 17. Once basin 100 has been extracted, or de-molded, from the mold, frame 7 is repositioned horizontal, as in FIG. 7, and carriage 5 is moved to platform 6, on which, after raising jaws 26, basin 100 is deposited, supported by form 101.

In accordance with the embodiment for de-molding columns 200, the operation proceeds in a substantially similar manner. Once the carriage has passed between the separated mold parts of the press, frame 38 is brought to the proper level and the structure 32 is advanced by the electric motor 33 until form 45 is in contact with columns 200 which are to be de-molded. Chamber 50 is then depressurized by valve 51, so that each column 200 adheres to the form. The actuation of motor 33 and cylinders 47 gently detach column 200 from the mold and carries it away. The column is then placed on a conveyor or similar means located outside the mold.

Although illustrative embodiments of the present invention have been described herein with reference to the accompanying drawings, it is to be understood that the invention is not limited to those precise embodiments and that various other changes and modifications may be effected therein by one skilled in the art without departing from the scope or spirit of the invention.

We claim:

1. An apparatus for de-molding a casting from a porous mold secured to a molding press, said mold including a pair of mold pads, first mold part and second mold part, said first mold part disposed directly opposite and facing said second mold part, said mold parts movable to and from an open position and a closed position, comprising:

a set of rails extending from a point outside a first side of said mold press through said press to a second point inside said press aligned below said pair of mold parts;

a movable carriage mounted on said set of rails, said carriage movable in a direction parallel to said rails;

a movable frame structure disposed on said carriage wherein said structure rotates about an axis perpendicular to said rails;

a movable form capable of matching an exterior of said casting;

a coupling means coupling said form to said movable frame structure, said coupling means including a platform positioned on an intermediate support means integral with said frame structure and held thereto by an elastic means; and a pneumatic means for holding said form to said casting.

2. The apparatus according to claim 1 wherein said support means includes a pair of hydraulic cylinders and a crank.

3. The apparatus according to claim 2 wherein said platform is secured to a pair of descending shafts, said shafts fixed to said movable frame structure.

4. The apparatus according to claim 3 wherein said platform includes a pair of hinges for clamping said form.

5. The apparatus according to claim 1 wherein said coupling means includes a flat vertical frame piece capable of traveling vertically on said movable frame structure and a projection attached to said vertical frame piece, said form fixed to said projection, said form further connected to said flat vertical frame by a cylinder.

6. The apparatus according to claim 1 wherein said pneumatic means includes a suction cup connected to a depression reservoir and integral with said platform.

* * * * *